US005600923A

United States Patent [19]

Riley

[11] Patent Number: 5,600,923

[45] Date of Patent: Feb. 11, 1997

[54] SAFE CORE BUILDING

[76] Inventor: Trevor J. Riley, 5739 - 136th Street, Surrey, B.C., Canada, V3X 1J4

[21] Appl. No.: 287,363

[22] Filed: Aug. 8, 1994

[51] Int. Cl.[6] ..... E04H 9/00

[52] U.S. Cl. ..... 52/79.9; 52/90.2; 52/169.6; 52/167.3; 109/15; 109/9

[58] Field of Search ..... 52/23, 3, 4, 22, 52/79.9, 79.14, 90.1, 90.2, 223.6, 262, 264, 167.3, 745.06, 169.6; 109/15, 9, 50

[56] References Cited

U.S. PATENT DOCUMENTS

| | | | |
|---|---|---|---|
| 1,836,814 | 12/1931 | Ramwald | 109/50 |
| 2,081,271 | 5/1937 | Ellithorpe | 109/9 |
| 2,548,758 | 4/1951 | Agle | 52/23 X |
| 3,008,435 | 11/1961 | Dupuy | 109/1.5 |
| 3,208,410 | 9/1965 | Hayes et al. | 109/1.5 |
| 3,854,256 | 12/1974 | Wilce | 52/223.6 X |
| 3,869,836 | 3/1975 | Allen | 52/23 |
| 3,999,338 | 12/1976 | Behan, Jr. et al. | 52/90.1 |
| 4,126,972 | 11/1978 | Silen | 52/169.6 X |
| 4,569,294 | 2/1986 | Beattie et al. | 109/50 X |
| 5,115,613 | 5/1992 | McCarthy | 52/169.6 |
| 5,210,985 | 5/1993 | Hsu | 52/169.6 |
| 5,279,088 | 1/1994 | Heydon | 52/223.6 X |
| 5,353,557 | 10/1994 | Lerner et al. | 52/79.9 X |
| 5,386,671 | 2/1995 | Hu et al. | 52/167.3 |

*Primary Examiner*—Lanna Mai
*Attorney, Agent, or Firm*—Norman M. Cameron

[57] ABSTRACT

A building has an exterior shell with exterior walls and a roof, defining an interior space. There is a fire resistant, structurally supportive core within the interior space. The core is preferably of hollow, reinforced concrete, having a door opening and a fire resistant door mounted adjacent thereto. There are support members inter-connecting the shell and the core. These may include cables connecting corners of the core to corners of the shell and connecting the roof of the shell to the roof of the core. There may also be rigid supports connecting the roof of the shell to the roof of the core.

4 Claims, 2 Drawing Sheets

SAFE CORE BUILDING

BACKGROUND OF THE INVENTION

This invention relates to buildings having earthquake resistant, fire resistant cores which can serve as temporary shelters.

Buildings, particularly houses, are typically not of fire resistant construction. In addition, they are susceptible to considerable damage due to earthquakes. Also such buildings are relatively insecure if threatened by intruders.

The concept of safe rooms or structures within dwelling places is previously known. For example, U.S. Pat. No. 5,210,985 to Hsu shows a fire escaping room. However, this room does not add to the structural integrity of the dwelling itself.

U.S. Pat. No. 5,115,613 to McCarthy shows a nuclear fallout shelter. The shelter provides short and long term protection against nuclear detonation. However it is not designed as an integral part of the building structure while adding to its strength and earthquake resistance.

Generally prior art safe rooms and the like comprise rooms or attachments to dwellings which are made of fire resistant, nuclear resistant or break-in resistant construction. However they generally are not an integral part of the building itself, adding to its structural strength and integrity.

SUMMARY OF THE INVENTION

It an object of the invention to provide an improved building construction for houses or the like which includes a safe area in the event of earthquakes, fires or break-ins.

It is also an object of the invention to provide an improved building construction which includes a safe area, but at the same time is an integral part of the building structure itself.

It is a further object of the invention to provide an improved building structure which includes a safe area, but generally strengthens the entire structure of the building to resist earthquakes, winds and other such forces.

In accordance with these objects, there is provided a building having an external shell with exterior walls and a roof defining an interior space. There is a fire resistant, structurally supportive core within the interior space. Support members interconnect the shell and the core.

Preferably the core is of reinforced concrete and is hollow, having a roof and walls. The support members may include cables extending from the roof and walls of the core to the roof and walls of the shell.

BRIEF DESCRIPTION OF THE DRAWINGS

Referring to the drawings.

DESCRIPTION OF THE PREFERRED EMBODIMENTS

Figure 1:
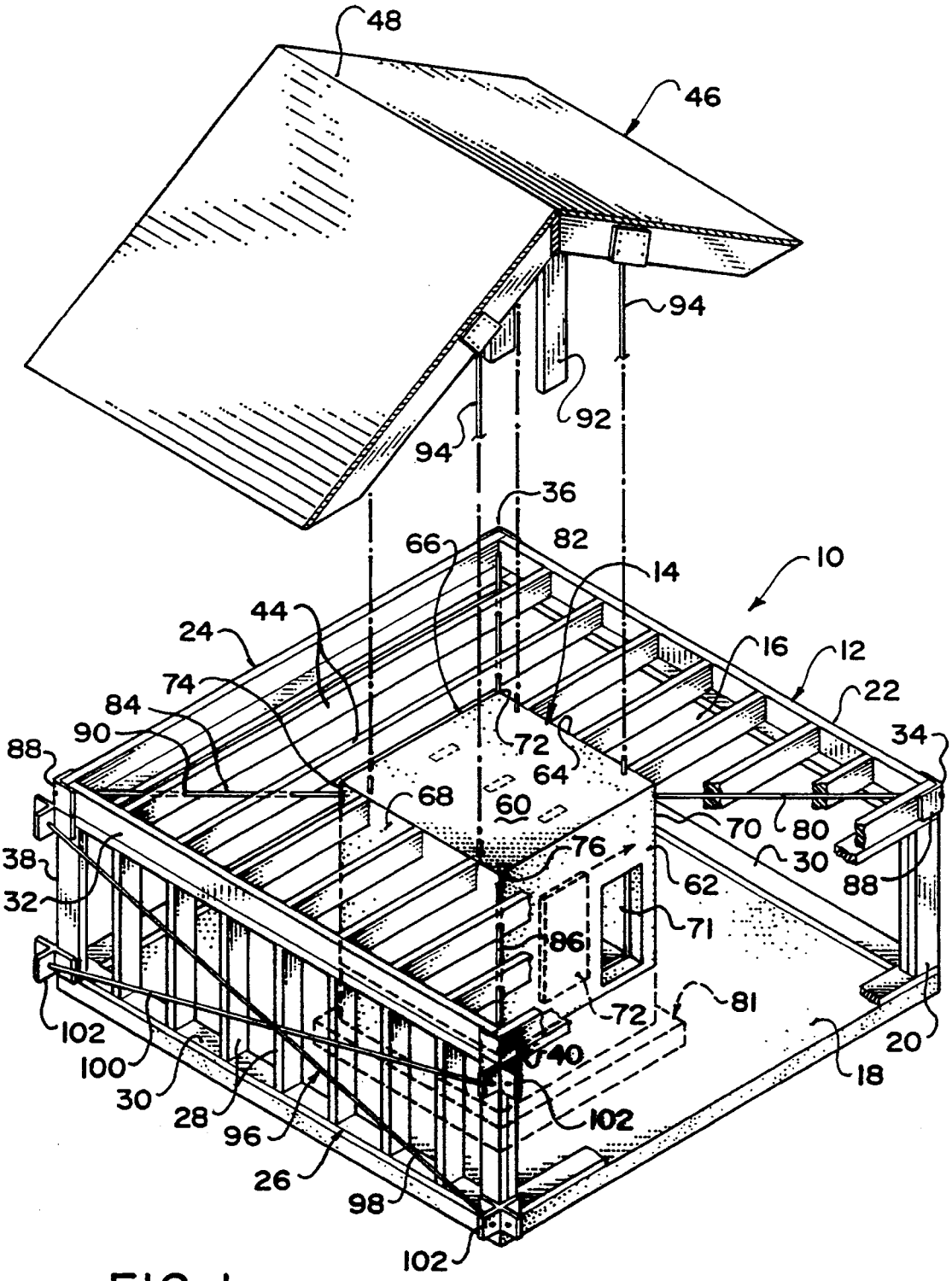
FIG. 1 is an exploded, isometric view of a building according to an embodiment of the invention, partly broken away with exterior wall coverings removed.

Referring to the drawings, these show a building 10 according to an embodiment of the invention which includes an exterior shell 12 and a fire resistant, structurally supportive core 14 located within interior space 16 of the shell.

The shell 12 is generally conventional in nature and in this instance is mounted on a rectangular concrete pad 18 which serves as a base or foundation. Alternatively the shell could be mounted on a concrete basement or other form of foundation. The shell in this embodiment includes four rectangular walls 20, 22, 24 and 26. These walls are of standard wood construction in this embodiment including a plurality of spaced-apart studs 28, wall plates 30 and cornices 32. The shell has corners 34, 36, 38 and 40 between adjacent walls. Ceiling joists 44 extend between cornices 32 of walls 22 and 26. This construction is standard and it should be recognized that the invention is applicable to many variations of the construction including masonry walls and multi story structures.

Figures 2, 3:
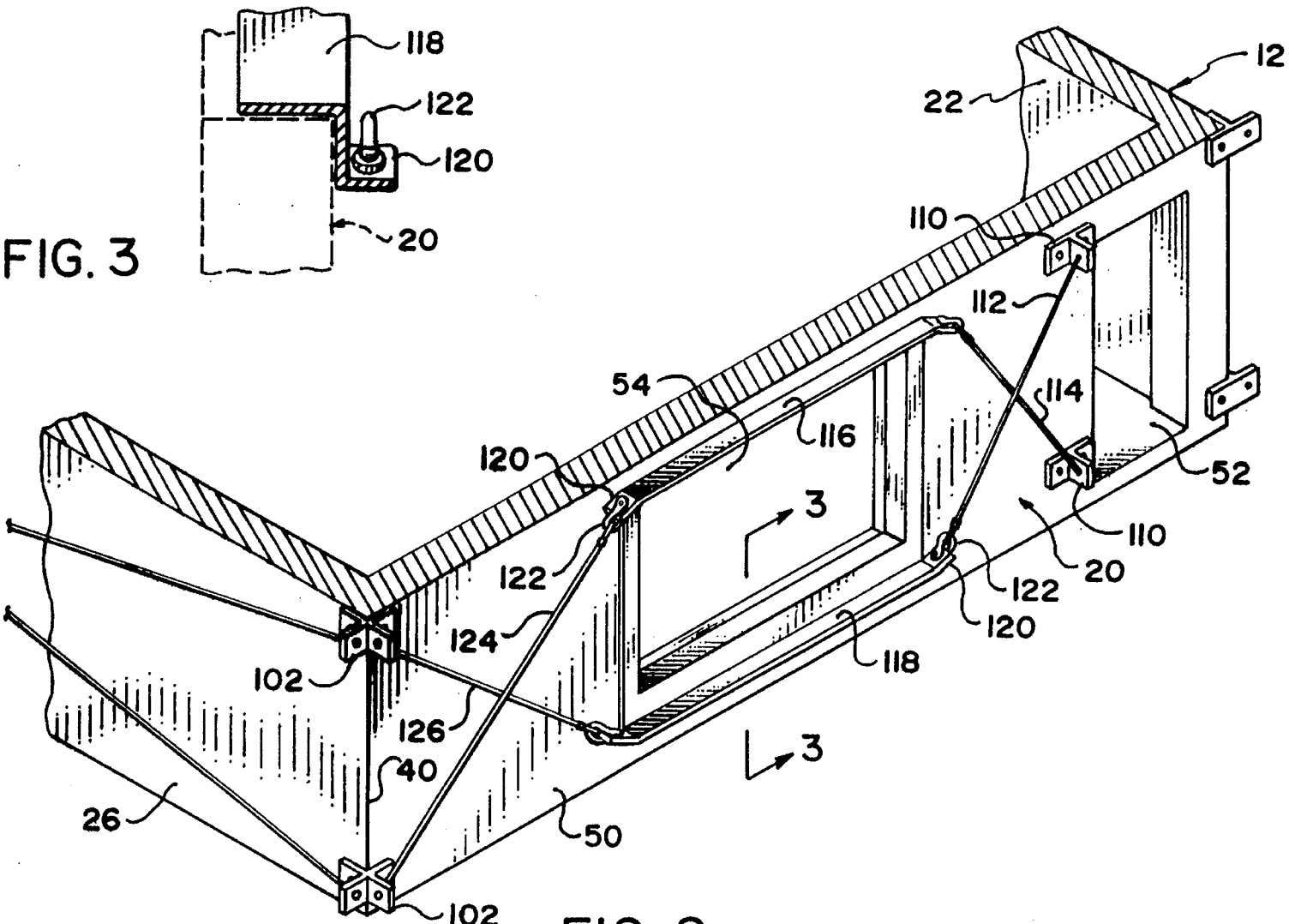
FIG. 2 is a fragmentary isometric view of one of the walls thereof showing cross bracing and elongated members above and below one of the wall openings thereof.
FIG. 3 is a sectional view taken along line 3—3 of FIG. 2.

A roof 46 is fitted on top of the shell and has a peak 48. In FIG. 1, the roof is shown above the structure for illustrative purposes although normally it would be lowered to contact the same. In addition, the external coverings of the walls and portions of the structure of walls 20, 22 and 24 are deleted in this illustration. Wall 20 is shown in FIG. 2 in semi-finished form including exterior sheathing 50, door opening 52 and window opening 54.

Referring to core 14 in more detail, it is of hollow, reinforced concrete construction in this embodiment. The core has a roof 60, four walls 62, 64, 66 and 68 which meet at corners 70, 72, 74 and 76. These corners are generally aligned with corresponding corners 34, 36, 38 and 40 of the shell. The core is mounted on a footing 81 which in this embodiment is located below pad 18.

The core has a door opening 71 which can be selectively closed by a sliding, fire resistant door 72. Other types of doors could be substituted.

The core is inter-connected with the shell by a plurality of support members including four cables 80, 82, 84 and 86 which extend diagonally between the corners of the core and the corners of the shell adjacent the tops thereof. The cables in this example are connected to the shell by anchors embedded in the concrete. Outer ends of the cables are connected to the corners of the shell by angle brackets 88. The cables pass through apertures 90 in the ceiling joists.

The support members also include a plurality of elongated, rigid members 92 which extend between the peak of the roof of the shell and the roof of the core. In this embodiment members 92 are of timber. There are also vertical cables 94 which extend between the roof 46 of the shell and the roof 60 of the core.

To provide earthquake resistance, there are cross-braces 96 on each wall of the shell. In simplest form each cross-brace includes a pair of cables 98 and 100 as shown for wall 26. The cables are connected to brackets 102 at the top and bottom of each end of the wall. The brackets in this example are cross-shaped when viewed in plan. Two arms thereof are connected to the wall by bolts or the like and the remaining two arms have apertures used for connecting cables.

Walls with openings, such as wall 20 shown in FIG. 2, are more complex because the cross-bracing must allow for the openings such as door opening 52 and window opening 54. In this example door opening 52 is adjacent one end of the wall 20. Special T-shaped brackets 110 are used near the top and bottom of the door for connecting cables 112 and 114. There are elongated, horizontal bars 116 and 118 above and below window opening 54. These are Z-shaped in section in this example as seen in FIG. 3. Ends 120 of these members are angled towards the opening and a shackle 122 is connected to each such angled end. These serve to connect the cables 112 and 114 on one side of the opening and cables 124 and 126 on the other end. Cables 124 and 126 form cross-bracing and are connected to two of the cross-shaped brackets 102 at corner 50.

Obviously the exact arrangement of wall 20 depends upon the locations and number of openings and this can be varied to suit the requirements of any particular wall using such components as illustrated or modifications thereof.

The cross-bracing of the walls adds stability and resistance to shaking encountered during earthquakes as do the cables and other supports inter-connecting the core and shell as described above. Thus the core serves as a solid support for the remaining structure of the dwelling.

The core 14 can serve as a safe location in the event of an emergency such as a forest fire or a house fire, home invasion or earthquake. To increase fire resistance, the core can be covered with an intumescent paint or fire board. Also the core should be equipped with a supply of water, emergency food and other emergency equipment such as blankets, a radio and a flashlight.

Two alternatives are available with respect to furnaces and hot water heaters. They can be located outside the core so that occupants of the core are protected from gas leakage or a fire originating with these appliances. Alternatively, the furnace and hot water heater can be located in the core to protect the rest of the dwelling from fire in the event of an earthquake or the like.

The embodiment shown in FIG. 1 includes only one such core. However, two or more cores can be employed for elongated buildings such as rancher style houses.

It will be understood by someone skilled in the art that many of the details provided above that many of the details provided above are by way of example only and are not intended to limit the scope of the invention which is to be interpreted with reference to the following claims.

What is claimed is:

1. A building comprising:

an exterior shell having exterior walls with corners and a roof defining an interior space, the walls of the shell having earthquake resistant bracing including cross-shaped bracing extending between the corners, the bracing including cables and brackets connected to the walls of the shell adjacent the corners thereof, the cables being connected to the brackets, said bracing further including elongated members extending horizontally above and below openings in the walls, the cables being connected to the elongated members;

a fire resistant, structurally supportive core within the interior space and spaced-apart from the shell; and means for structurally reinforcing the shell including support members interconnecting the shell and the core.

2. A building as claimed in claim 1, wherein the elongated members are rigid bars.

3. A building comprising:

an exterior shell having four exterior walls, four corners and a roof defining an interior space;

a fire resistant, structurally supportive core within the interior space having a roof and walls and being spaced-apart from the shell, the core being rectangular with four walls and four corners and being near the center of the building; and means for structurally reinforcing the shell including support members interconnecting the shell and the core, the support members extending from the roof and walls of the core to the roof and walls of the shell, the support members including four cables extending from the corners of the core to the corners of the shell.

4. A building comprising:

an exterior shell having exterior walls and a roof and defining an interior space;

a fire resistant, structurally supportive core within the interior space having a roof and walls and being spaced-apart from the shell; and means for structurally reinforcing the shell including support members interconnecting the shell and the core, the support members extending from the roof and walls of the core to the roof and walls of the shell, the support members including cables extending vertically between the roof of the shell and the roof of the core.

* * * * *